US008969692B2

(12) United States Patent
Sanns, Jr.

(10) Patent No.: US 8,969,692 B2
(45) Date of Patent: Mar. 3, 2015

(54) ACOUSTIC STRING TENSION COMPENSATING METHOD AND APPARATUS

(76) Inventor: Frank Sanns, Jr., Pittsburgh, PA (US)

( * ) Notice: Subject to any disclaimer, the term of this patent is extended or adjusted under 35 U.S.C. 154(b) by 48 days.

(21) Appl. No.: 13/807,511

(22) PCT Filed: Jan. 10, 2012

(86) PCT No.: PCT/US2012/020776

§ 371 (c)(1),
(2), (4) Date: Dec. 28, 2012

(87) PCT Pub. No.: WO2012/096957

PCT Pub. Date: Jul. 19, 2012

(65) Prior Publication Data

US 2013/0098222 A1 Apr. 25, 2013

Related U.S. Application Data

(60) Provisional application No. 61/431,612, filed on Jan. 11, 2011.

(51) Int. Cl.

| | |
|---|---|
| ***G10D 3/00*** | (2006.01) |
| ***G10D 3/12*** | (2006.01) |
| ***G10D 1/08*** | (2006.01) |

(52) U.S. Cl.

CPC .. *G10D 3/00* (2013.01); *G10D 3/12* (2013.01); *G10D 1/08* (2013.01)

USPC ..... 84/291

(58) Field of Classification Search

CPC ..... G10D 1/08; G10D 3/12; G10D 3/00

USPC ..... 84/291

See application file for complete search history.

(56) References Cited

U.S. PATENT DOCUMENTS

| | | | | |
|---|---|---|---|---|
| 651,146 | A * | 6/1900 | Rogers | 84/267 |
| 685,920 | A * | 11/1901 | Heck | 84/294 |
| 2,473,980 | A * | 6/1949 | Willner | 84/271 |
| 2,727,422 | A | 12/1955 | McBride | |
| 3,521,374 | A * | 7/1970 | Reynolds | 34/428 |
| 3,690,210 | A * | 9/1972 | Imai et al. | 84/267 |
| 3,853,031 | A * | 12/1974 | DeWitt et al. | 84/267 |
| 4,026,181 | A * | 5/1977 | Barcus et al. | 84/291 |
| 4,206,678 | A * | 6/1980 | Espinos Guerrero | 84/267 |
| 4,253,371 | A * | 3/1981 | Guice | 84/267 |
| 4,930,389 | A * | 6/1990 | Kunstadt | 84/293 |
| 5,025,695 | A * | 6/1991 | Viel | 84/293 |
| 5,567,895 | A * | 10/1996 | Aspri et al. | 84/294 |
| 6,040,510 | A * | 3/2000 | Yaun | 84/294 |
| 6,459,024 | B1 * | 10/2002 | Baker | 84/291 |
| 7,446,247 | B2 * | 11/2008 | Shellhammer | 84/291 |
| 7,462,767 | B1 * | 12/2008 | Swift | 84/291 |
| 8,138,403 | B1 * | 3/2012 | Kemp | 84/291 |
| 8,203,059 | B2 * | 6/2012 | Miloslavsky | 84/291 |
| 8,222,503 | B2 * | 7/2012 | Aspri | 84/294 |
| 8,648,238 | B1 * | 2/2014 | Trabits | 84/298 |
| 2005/0051019 | A1 | 3/2005 | Machida | |
| 2008/0190263 | A1 * | 8/2008 | Drew | 84/291 |
| 2012/0285310 | A1 * | 11/2012 | Miltimore | 84/291 |
| 2013/0098222 | A1 * | 4/2013 | Sanns, Jr. | 84/267 |

FOREIGN PATENT DOCUMENTS

WO 0045372 A1 8/2000

* cited by examiner

*Primary Examiner* — Robert W Horn

(74) *Attorney, Agent, or Firm* — McNees Wallace & Nurick LLC

(57) ABSTRACT

An apparatus and method are disclosed for compensating for string tension acting upon the body of an acoustic instrument. An acoustic instrument incorporating the string tension compensating apparatus is also disclosed.

8 Claims, 4 Drawing Sheets

ACOUSTIC STRING TENSION COMPENSATING METHOD AND APPARATUS

CROSS-REFERENCE TO RELATED APPLICATIONS

This application claims the benefit of U.S. Provisional Application No. 61/431,612, entitled "ACOUSTIC STRING TENSION COMPENSATING METHOD AND APPARATUS," filed Jan. 11, 2011, which application is hereby incorporated by reference in its entirety.

FIELD

The present disclosure is generally directed to acoustic instruments, and is more particularly directed to an apparatus and method for compensating for string tension acting upon the instrument body.

BACKGROUND

In many acoustic instruments, strings are terminated to a bridge that is attached to the body of the acoustic instrument. In the normal design of an acoustic instrument, such as a guitar, the bridge of the instrument feels substantial force from the tension of the strings. This force can be in excess of 150 lbs and the torque on the order of several foot pounds. This places substantial stress on the top sound producing surface of the instrument and requires elaborate bracing of the top in an attempt to balance strength with the freedom to vibrate for sound production. Heavy bracing or thick top surfaces are strong but do not vibrate well. Light bracing and/or thin tops vibrate well but with time can bulge (belly) and lose sound quality, or mechanically fail altogether.

There is a need for an effective apparatus and method for compensating for string tension acting upon the body of an acoustic instrument.

Intended advantages of the disclosed systems and/or methods satisfy one or more of these needs or provide other advantageous features. Other features and advantages will be made apparent from the present specification. The teachings disclosed extend to those embodiments that fall within the scope of the claims, regardless of whether they accomplish one or more of the aforementioned needs.

SUMMARY OF THE DISCLOSURE

In one embodiment there is disclosed a method for compensating for string tension in an acoustic musical instrument comprising a neck, a soundboard, strings and a bridge. The method includes coupling at least one tension coupling between the bridge of the musical instrument and structural members of the musical instrument; and adjusting the at least one tension coupling to counter forces applied to the soundboard by the strings.

In another embodiment the disclosure includes a counteracting lever system for an acoustic instrument comprising a neck, a soundboard, strings and a bridge. The counteracting lever system includes a tension coupling attached at a first end to a surface of the acoustic instrument.

In yet another embodiment, what is disclosed is an acoustic instrument. The acoustic instrument includes a bridge and a counteracting lever system. The counteracting lever system includes tension couplings attached proximate to the bridge.

This invention transfers the forces to more substantial structural members of the guitar that are not a significant part of the sound forming surfaces, e.g., an end block or an area of the end pin.

An advantage of the present invention is that lighter braced and/or thinner tops are possible since stresses are transferred from the top to the edges and sides. This gives an instrument that is more responsive to the touch and potentially more volume, dynamic range, and or tonal complexity.

Another advantage of the present invention is that heavier gage strings can be used on lighter braced instruments. Heavier strings typically give more volume and fullness to the tone.

Another advantage of the present invention is that more or less symmetry of the bracing is possible for more unique voicing (tonal quality as a function of pitch or position that it is played on the fretboard) of an instrument.

Another advantage of the present invention is that the voice can be adjusted by the musician or luthier and is reversible.

Another advantage of the present invention is that new design and tonal property instruments are now possible since conventional braces that have always been there for structural integrity can be moved or removed all together giving more design freedom based on tone and volume than ever before.

DETAILED DESCRIPTION

Figure 1:
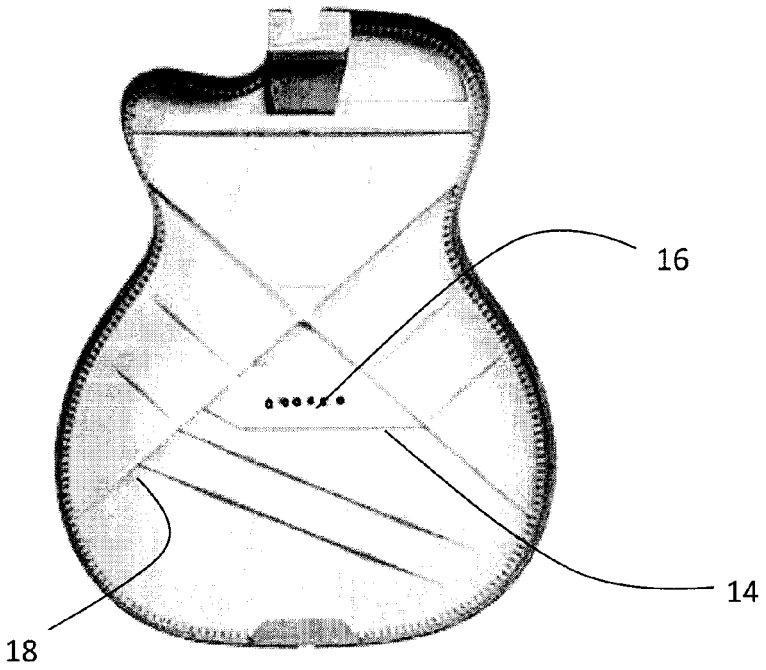
FIG. 1 shows a reverse or internal side of a soundboard of an exemplary acoustic musical instrument.
Figure 2:
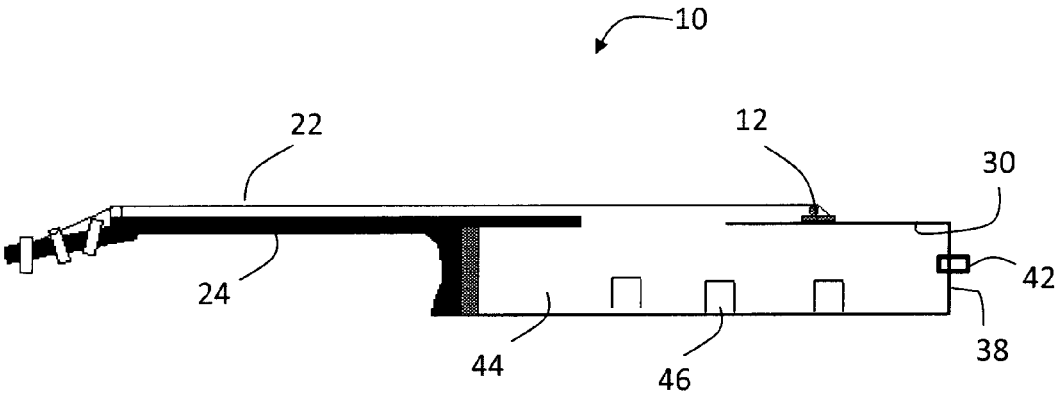
FIG. 2 shows a cross-sectional elevational view of an exemplary instrument.

Referring to FIGS. 1 and 2, the invention herein relieves stresses from the bridge 12 and/or soundboard 30. A stress relief device or counteracting lever system 410 (FIG. 4) may be an integral part of the bridge 12 or an area 14 immediately adjacent to bridge 12 on sound board 30 (blue in FIG. 1). In an embodiment, stress relief device 410 (FIG. 4) attaches on one end to a bridge plate 16, or to area 14 for already built guitars), or to the cross-bracing on the rear of soundboard 30 near bridge 12 or to the underside of the soundboard 30. The opposite end of stress relief device 410 is attached to internal structural members of instrument 10, and transfer the forces to more substantial structural members of the guitar 10 that are not a significant part of the sound forming surfaces, e.g., an end block 38, area of end pin 42, backboard 44 and internal backboard bracing 46.

Figure 3:
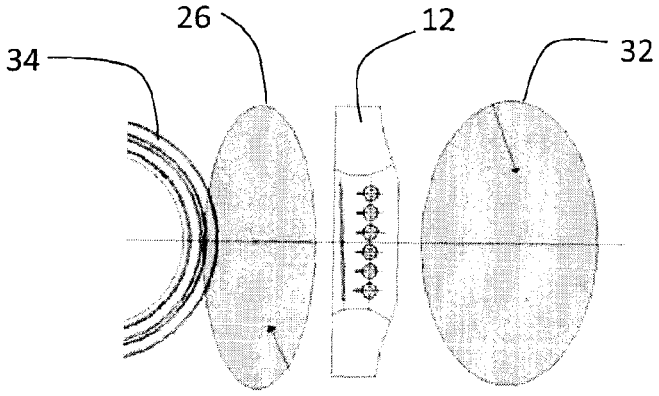
FIG. 3 shows a partial top view of a guitar soundboard in the bridge area.

Referring to FIGS. 2 and 3, it can be seen that the strings 22 generate a tension that is pulling toward the neck 24, which acts to pull bridge 12 towards the neck and the top of the guitar 10. The bracing 18 must be strong enough to resist the applied string tension. In addition strings 22 create a torque that causes bridge 12 to be twisted in a counterclockwise direction.

Even new guitars will show some of the phenomenon discussed above, but significant problems can develop due to the torque and tension on the bridge as time passes. Referring to FIG. 3, the top surface 28 of soundboard 30 may become deformed, in particular in the regions 26, 32 above and below bridge 12. Top surface region 26, located between the sound hole 34 and bridge 12, may become concave in region 26 due to torque applied to bridge 12 by strings 22. On the opposite side of bridge 12 opposite top surface region 26, the top surface region 32 may become convex, or belly up to form a hump, due to torque applied to bridge 12 by strings 22.

In addition to the potential structural problems occurring with time, the volume, tonal characteristics, playability, and other factors associated with musical quality, can degrade.

The string generated forces may be transferred to the outer, stronger edges of the guitar and/or to the end block, via more substantial structural member. This is accomplished by use a counteracting lever system, pulleys, and/or springs. Ideally the spring tension could be adjusted by the luthier as well as the musician.

Figure 4:
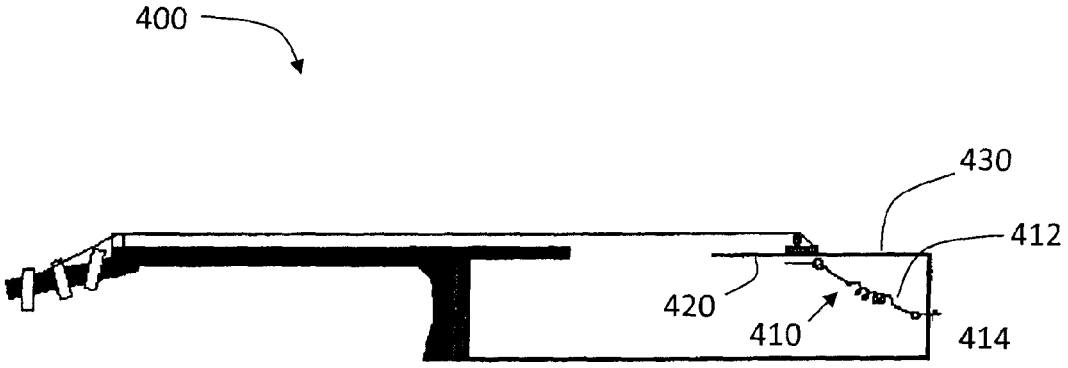
FIG. 4 shows a cross-sectional elevational view of an exemplary instrument with a tension coupling device.

FIG. 4 shows an embodiment of an acoustic instrument 400 including a tension coupling device 410 according to the invention. As can be seen in FIG. 4, acoustic tension coupling device 410 is attached to the inner or bottom surface 420 of soundboard 430. The acoustic tension coupling device 410 allows the torque and the tension of strings 22 on bridge 12 to be adjusted. In another embodiment, acoustic tension coupling device 410 may be attached to the outside surface of soundboard 430. In yet another embodiment, strings 22 may be terminally attached to bridge 12, the outside surface of the soundboard, the inside surface of the soundboard, and any combination thereof.

Acoustic tension coupling device 410 includes an elastic member 412 and an adjustment device 414. In another embodiment, one or more acoustic tension coupling devices 410 may be used on guitar 400. In this embodiment, the elastic member 412 may be a wire spring. In another embodiment, the elastic member 412 may be an elastic band, spring, counteracting lever system, pulley, or combinations thereof, or any other device, similar to a spring, which retracts to its initial length after a force stretches the device to an elongated length. In another embodiment, one or more elastic members may be used. In another embodiment, one or more acoustic tension coupling devices may be used. Additionally, in this embodiment, the adjustment device 414 is an adjustable screw. In another embodiment, the adjustment device 414 may be any device capable of adjusting the length of the elastic member 412. In another embodiment, one or more adjustment devices 414 may be used.

Figure 5:
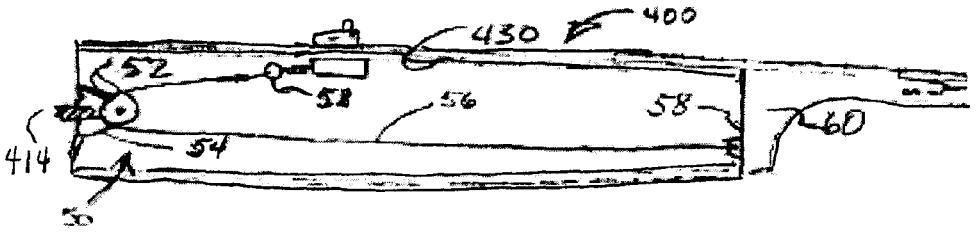
FIG. 5 shows a cross-sectional view of an exemplary acoustic instrument having a compound pulley tension system.
Figure 6:
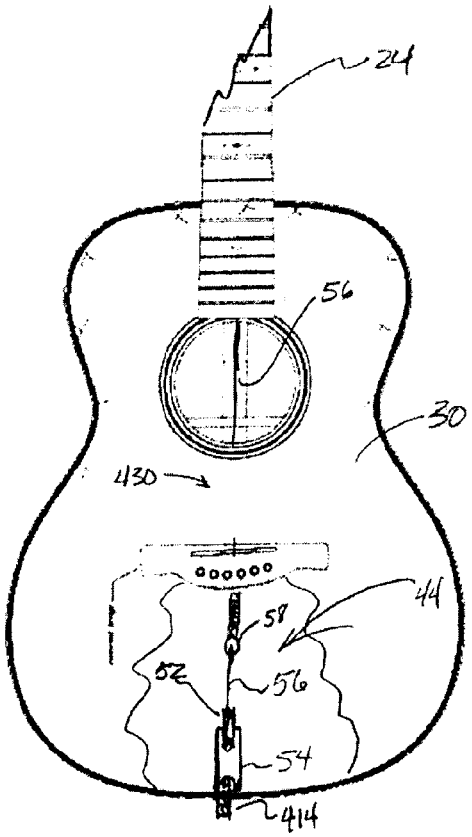
FIG. 6 shows a partially cut-away top view of an exemplary instrument having a compound pulley tension system.

Referring next to FIG. 5 and FIG. 6, an exemplary embodiment of acoustic instrument 400 includes a compound pulley system 50. Pulley system 50 includes a pulley wheel 52 connected by a bracket 54 to adjustment device 414 on end block 38. A tensioning line 56 is attached at an eyelet anchor 58 at one end. Tensioning line 56 is threaded around pulley wheel 52 and terminated at the opposite end to side wall 58 adjacent the heel 60. In an alternate embodiment the termination points of the tensioning 56 line may be at any point along the sidewall 58, e.g., points that are off-center of the guitar neck. Pulley tension may be adjusted at eyelet anchor 58 or tension adjustment device 414. It should be noted that while the eyelet is used as a termination point at bridge 12, any suitable fastener for terminating line 56 may be substituted for the eyelet within the scope of the disclosure. Similarly, line 56 may be any suitable line material. Non-limiting examples include wire, rope, wire rope, cord, belt, chain, rubber, or woven fabric which is capable of withstanding the tension forces and torques applied to the acoustic instrument 400. In addition, additional pulleys may be employed in multiple-pulley arrangements to increase the force applied by line 56 to bridge 12 and sound board 430, as will be appreciated by those skilled in the art.

Figure 7:
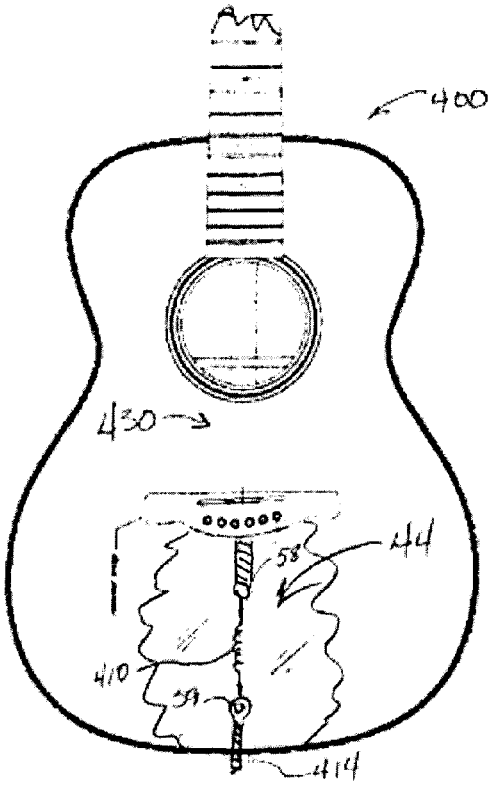
FIG. 7 shows a partially cut-away top view of an exemplary instrument having a pair of eyelet anchors for separate control of tension force and torque compensation.

FIG. 7 shows a partial cut-away view of another embodiment of acoustic instrument 400 including a pair of eyelet anchors 58, 59, attached to tension coupling device 410. The double anchor variable tension coupling device 410 allows separate control of tension force and torque compensation. Eyelet anchor 58 applies torque compensation independently of string tension compensation which is provided by eyelet anchor 59.

Figure 8:
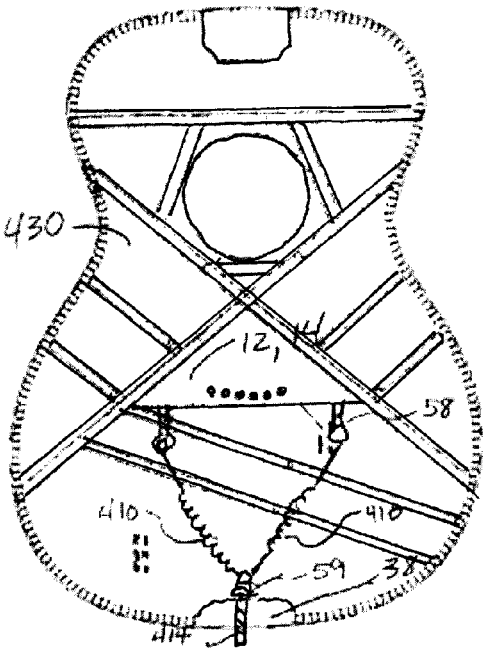
FIG. 8 shows a rear view of a soundboard of another embodiment of an exemplary instrument having a plurality of springs and tensioning eyelets.

FIG. 8 shows a bottom plan view of soundboard 430 of another embodiment of an exemplary acoustic instrument having a plurality of springs 410 and tensioning eyelet anchors 58, 59. An eyelet anchor 58 is disposed adjacent bridge 12 or bridge area 14 at opposite ends of bridge 12. Springs 410 are attached between eyelet anchors 58 at one end and at a common eyelet anchor 59 adjacent end block 38. Eyelet anchors 58 apply torque compensation that is distributed to either end of bridge 12, and separately, string tension compensation is provided by eyelet anchor 59.

Figure 9:
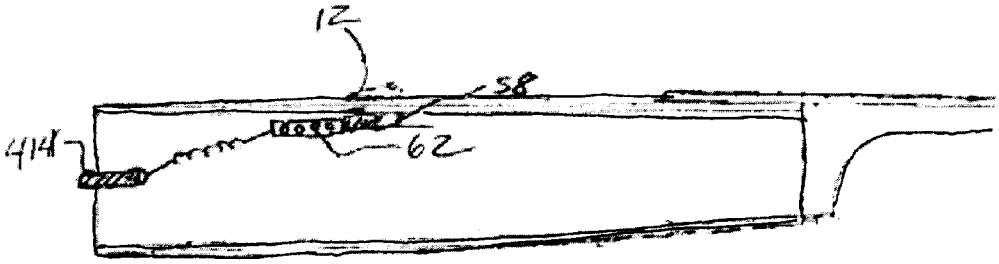
FIG. 9 shows a partial cross-sectional view of an exemplary instrument having a plurality of eyelet adjustments.

FIG. 9 shows a partial cross-sectional view of an exemplary instrument having a plurality of eyelets 62 in eyelet anchor 58. Torque compensation on bridge 12 may be increased or decreased by changing the eyelet 62 to which spring or springs 410 are attached. The opposite end of the spring or springs 410 are attached to adjustment device 414 on end block 38, as described above with respect to FIGS. 5 and 6.

Figure 10:
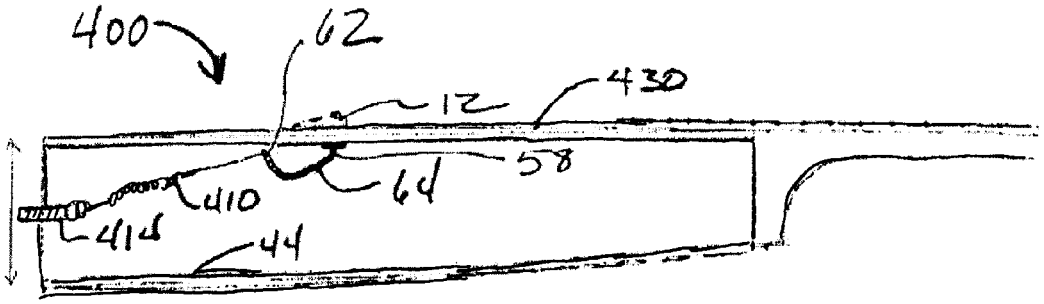
FIG. 10 shows a partial cross-sectional view of an exemplary instrument having a tensioning bracket.

FIG. 10 shows a partial cross-sectional view of an exemplary instrument having a tensioning bracket 64 fastened to bridge 12 or area 14 beneath soundboard 430. Bracket 64 may include one or more eyelets 62 for varying torque applied to bridge 12, as described above with respect to FIG. 9. Bracket 64 provides an offset clearance on the underside of soundboard 430, to allow spring 410 and eyelet anchors 58 sufficient clearance below structural bracing 18 to avoid interference with the bracing 18. Bracket 64 may be applied to any or all of the disclosed embodiments to provide necessary clearance for tension coupling device 410 and associated elements to function. Bracket 64 may be adapted in different shapes for specific configurations of soundboard bracing and other structure of the acoustic instrument 400, which may vary from one instrument to another as will be appreciated by those skilled in the art.

It should be noted that a fixed tension coupling may be employed based upon the teachings in the above disclosure, using the method and apparatus. It would be appreciated by one skilled in the art to determine the appropriate ratio of arm lengths and to arrive at the disclosed invention with an adjustable one and provide a fixed, non-adjustable tension coupling on an acoustic instrument, within the scope of the appended claims.

It is important to note that the construction and arrangement of the acoustic tension coupling device as shown in the various exemplary embodiments is illustrative only. Although only a few embodiments have been described in detail in this disclosure, those who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A counteracting lever system for an acoustic instrument comprising a neck, a soundboard, strings and a bridge, the system comprising: at least one elastic tension coupling attached at a first end to a surface of the acoustic instrument; wherein the at least one elastic tension coupling is attached to the cross-bracing on a rear portion of the soundboard adjacent the bridge.

2. The counteracting lever system of claim 1, wherein the at least one elastic tension coupling is attached at a second end to a structural member of the acoustic instrument.

3. The counteracting lever system of clarrn 1, wherein the at least one elastic tension coupling is attached to a bridge plate.

4. The counteracting lever system of claim 1, wherein the at least one elastic tension coupling is attached to an area adjacent to a bridge plate.

5. The counteracting lever system of claim 1, wherein the at least one elastic tension coupling is attached to an underside of the soundboard.

6. The counteracting lever system of claim 1, wherein a second end. of adjustable the at least one elastic tension coupling is attached to at least one structural. member of the musical instrument to transfer string tension forces from the bridge to the at least one structural members.

7. The counteracting lever system of claim 6, wherein the at least one structural member is not a significant sound forming surface of the instrument.

8. The counteracting lever system of claim 1, wherein the at least one structural member is one of: an end block, an area of an end pin, a backboard, and an internal backboard bracing.

* * * * *